US007727944B2

(12) United States Patent
Konzman et al.

(10) Patent No.: US 7,727,944 B2
(45) Date of Patent: Jun. 1, 2010

(54) LUBRICANT COMPOSITIONS CONTAINING SEAL CONDITIONING AGENTS

(75) Inventors: Edward J. Konzman, Eastlake, OH (US); Richard M. Lange, Euclid, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 403 days.

(21) Appl. No.: 11/573,785

(22) PCT Filed: Aug. 9, 2005

(86) PCT No.: PCT/US2005/028145

§ 371 (c)(1),
(2), (4) Date: Feb. 16, 2007

(87) PCT Pub. No.: WO2006/023317

PCT Pub. Date: Mar. 2, 2006

(65) Prior Publication Data

US 2007/0298984 A1 Dec. 27, 2007

Related U.S. Application Data

(60) Provisional application No. 60/602,740, filed on Aug. 18, 2004.

(51) Int. Cl.
*C10M 135/08* (2006.01)
*C10M 129/76* (2006.01)

(52) U.S. Cl. ..... 508/303; 508/302; 508/305; 508/478; 508/501; 508/550

(58) Field of Classification Search ..... 508/501, 508/502, 302, 303
See application file for complete search history.

(56) References Cited

U.S. PATENT DOCUMENTS 4,029,587 A 6/1977 Koch
4,029,588 A * 6/1977 Koch ..... 508/303
4,098,708 A 7/1978 Stuebe et al.
4,209,408 A 6/1980 Hoke
4,264,460 A 4/1981 Gutierrez et al.
4,582,618 A 4/1986 Davis
5,523,007 A 6/1996 Kristen et al.
5,912,212 A * 6/1999 Igarashi et al. ..... 508/275
6,362,136 B1 * 3/2002 Richardson et al. ..... 508/186
6,559,105 B2 * 5/2003 Abraham et al. ..... 508/186
6,642,191 B2 * 11/2003 Palazzotto et al. ..... 508/501
6,750,184 B2 * 6/2004 Ribeaud et al. ..... 508/375
6,756,348 B2 * 6/2004 Palazzotto et al. ..... 508/503
7,214,648 B2 * 5/2007 Saini et al. ..... 508/167
7,485,734 B2 * 2/2009 Kadkhodayan et al. ..... 549/67
2002/0006878 A1 1/2002 Abraham et al.
2002/0147116 A1 10/2002 Carrick et al.

FOREIGN PATENT DOCUMENTS

DE 2706937 8/1978
GB 1532458 11/1998

* cited by examiner

*Primary Examiner*—Ellen M McAvoy
(74) *Attorney, Agent, or Firm*—David M. Shold; Christopher D. Hilker

(57) ABSTRACT

Compositions of an ester-containing phenolic antioxidant seal-conditioning agent represented by the formula and a second seal-conditioning agent selected from sulfolanes, benzyl ester, lactones, nitriles, and other ester-containing phenolic anitoxidant seal-conditioning agents, serve to protect the integrity of elastomeric materials in contact with lubricants.

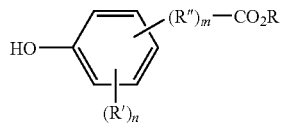

7 Claims, No Drawings

LUBRICANT COMPOSITIONS CONTAINING SEAL CONDITIONING AGENTS

This application claims priority from U.S. Provisional Application 60/602,740, filed Aug. 18, 2004.

BACKGROUND OF THE INVENTION

The present invention relates to compositions suitable for use as lubricants and lubricant additives which contain a combination of conditioning agents for preserving the integrity of elastomeric materials, for instance, an ester-substituted hindered phenol antioxidant and a swell agent, e.g., a sulfolane.

Ester-substituted hindered phenol antioxidants are known from, for example, U.S. Pat. No. 5,523,007, Kristen et al., Jun. 4, 1996, and U.S. Pat. No. 6,559,105, May 6, 2003.

Seal swelling agents, including substituted sulfolanes, are known from U.S. Pat. No. 4,029,587, Koch, Jun. 14, 1977.

The present invention provides, among other advantages, a mixture of conditioning agents for preserving the integrity of elastomeric materials, particularly when in contact with lubricants. In certain embodiments, the mixture of agents exhibits synergy. Rubber seals are critically important to the proper operation of many engines, power transmission devices, pumps, gears, and bearings. Preserving the integrity of seals in such devices is desirable, in order to lower the maintenance costs of operation and to prevent unexpected loss of lubricant that could result in catastrophic mechanical failure.

SUMMARY OF THE INVENTION

The present invention provides a composition comprising:

(A) at least one ester-containing phenolic antioxidant seal-conditioning agent represented by the formula

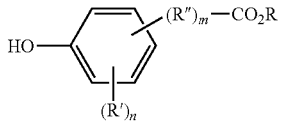

wherein n is 0, 1, 2, or 3, each R' is independently an alkyl group of 1 to about 8 carbon atoms, m is 1 or 0, R" is an alkylene group of 1 to about 6 carbon atoms or such an alkylene group substituted with a second phenolic group, and R is a hydrocarbyl group of 1 to 10 carbon atoms, provided that when m is 1 and R is an alkyl group, then R is an alkyl group of 2 to 6 carbon atoms; and (B) at least one second seal-conditioning agent selected from the group consisting of sulfolanes, benzyl esters, lactones, nitriles, and ester-containing phenolic antioxidant seal-conditioning agents other than the agent selected for (A).

The invention further provides lubricant formulations comprising the above compositions in an oil of lubricating viscosity, as well as a method for lubricating a mechanical device comprising elastomeric materials, such as seals, comprising supplying thereto such a lubricant.

DETAILED DESCRIPTION OF THE INVENTION

Various preferred features and embodiments will be described below by way of non-limiting illustration.

Oil of Lubricating Viscosity

Although not required in all embodiments of this invention, commonly an oil of lubricating viscosity is employed as a medium dissolving or dispersing the other components, particularly for providing the lubricant compositions of the present invention. Oils of lubricating viscosity include natural and synthetic lubricating oils and mixtures thereof. These lubricants include crankcase lubricating oils for spark-ignited and compression-ignited internal combustion engines, including automobile and truck engines, two-cycle engines, aviation piston engines, and marine and railroad diesel engines. They can also be used in gas engines, stationary power engines, and turbines. Automatic transmission fluids, transaxle lubricants, gear lubricants, metal-working lubricants, hydraulic fluids and other lubricating oil and grease compositions can also benefit from the incorporation therein of the compositions of the present invention.

Natural oils include animal oils and vegetable oils (e.g., castor oil, lard oil) as well as liquid petroleum oils and solvent-treated or acid-treated mineral lubricating oils of the paraffinic, naphthenic or mixed paraffinic-naphthenic types. Oils of lubricating viscosity derived from coal or shale are also useful base oils. Synthetic lubricating oils include hydrocarbon oils such as polymerized and interpolymerized olefins (e.g., α-olefin homopolymers and copolymers, including polybutylenes, polypropylenes, propylene-isobutylene copolymers, poly(1-hexenes), poly(1-octenes), poly(1-decenes), and mixtures thereof in copolymers); alkylbenzenes (e.g., dodecylbenzenes, tetradecylbenzenes, dinonylbenzenes, and di(2-ethylhexyl)-benzenes); alkyl naphthalenes; polyphenyls (e.g., biphenyls, terphenyls, and alkylated polyphenyls), alkylated diphenyl ethers and alkylated diphenyl sulfides and the derivatives, analogs, and homologs thereof.

Alkylene oxide polymers and interpolymers and derivatives thereof where the terminal hydroxyl groups have been modified by esterification, etherification, or similar reaction constitute another class of known synthetic lubricating oils. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of 1,000 diphenyl ether of polyethylene glycol having a molecular weight of 500-1,000, diethyl ether of polypropylene glycol having a molecular weight of 1,000-1,500) or mono- and polycarboxylic esters thereof, for example, the acetic acid esters, mixed $C_3$-$C_8$ fatty acid esters, or the $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkyl malonic acids, and alkenyl malonic acids) with a variety of alcohols (e.g., butyl alcohol, hexyl alcohol, dodecyl alcohol, 2-ethylhexyl alcohol, ethylene glycol, diethylene glycol monoether, and propylene glycol). Specific examples of these esters include dibutyl adipate, di(2-ethylhexyl sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol, and tripentaerythritol.

Unrefined, refined and rerefined oils (and mixtures of each with each other) of the type disclosed hereinabove can be used in the lubricant compositions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except that they have been further treated in one or more purification steps to improve one or more properties. Many such purification techniques are known to those of skill in the art such a solvent extraction, acid or base extraction, filtration, percolation, or similar purification techniques. Rerefined oils are obtained by processes similar to those used to obtain refined oils which have been already used in service. Such rerefined oils are also known as reclaimed or reprocessed oils and often are additionally processed by techniques directed to removal of spent additives and oil breakdown products.

In one embodiment, the oil of lubricating viscosity a Group II or a group III oil, or a synthetic oil, or mixtures thereof. Group II and Group III oils are classifications established by the API Base Oil Interchangeability Guidelines. Both Group II and Group III oils contain <0.03 percent sulfur and >90 percent saturates. Group II oils have a viscosity index of 80 to 120, and Group III oils have a viscosity index >120. Polyalphaolefins are categorized as Group IV. The oil can also be an oil derived from a Fischer-Tropsch synthesis.

The aliphatic and alicyclic substituents, as well as aryl nuclei, are generally described as "hydrocarbon-based". The meaning of the term "hydrocarbon-based"as used herein is apparent from the following detailed discussion of "hydrocarbon-based substituent."

As used herein, the terms "hydrocarbon-based substituent," "hydrocarbyl substituent" or "hydrocarbyl group," which are used synonymously, are used in their ordinary sense, which is well-known to those skilled in the art. Specifically, any of these terms refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(2) substituted hydrocarbon substituents, that is, substituents containing non-hydrocarbon groups which, in the context of this invention, do not alter the predominantly hydrocarbon substituent (e.g., halo (especially chloro, and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, or no more than one, non-hydrocarbon substituent will be present for every ten carbon atoms in the hydrocarbyl group; typically, there will be no non-hydrocarbon substituents in the hydrocarbyl group.

In one embodiment, the hydrocarbon-based substituents in the compositions of this invention are free from acetylenic unsaturation. Ethylenic unsaturation, when present, typically will be such that no more than one ethylenic lineage will be present for every 10 carbon-to-carbon bonds in the substituent. The hydrocarbon-based substituents are usually hydrocarbon in nature and more usually, substantially saturated hydrocarbon. As used in this specification and the appended claims, the word "lower" denotes substituents or groups containing up to seven carbon atoms; for example, lower alkoxy, lower alkyl, lower alkenyl, lower aliphatic aldehyde.

The amount of lubricating oil in a fully formulated lubricant of the present invention (including the diluent or carrier oils present in additive packages) is typically 80 to 99.5 weight percent, or 85 to 96 weight percent, or 90 to 95 weight percent. The lubricating oil can also be used to prepare concentrates containing the additives of the present invention in higher concentrations. The amount of such oil in a concentrate is typically 20 to 80 weight percent.

(A) The Ester-Containing Phenolic Antioxidant Seal-Conditioning Agent

One component of the present invention is an ester-containing phenolic antioxidant seal-conditioning agent, which is represented by the formula

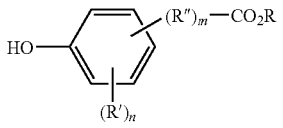

wherein n is 0, 1, 2, or 3, each R' is independently an alkyl group of (that is, containing or having) 1 to 8 carbon atoms, m is 1 or 0, R" is an alkylene group of 1 to about 6 carbon atoms or such an alkylene group substituted with a second phenolic group, and R is a hydrocarbyl group of 1 to 10 or 1 to 8 carbon atoms, provided that when m is 1 and R is an alkyl group, then R is an alkyl group of 2 to 6 carbon atoms. In another embodiment, when m is 1, R is an alkyl or hydrocarbyl group of 2 to 6 carbon atoms. In certain embodiments, n can be 1 or 2, corresponding, for example, to t-butyl groups which may be ortho to the hydroxyl group. In certain embodiments R' can be an alkyl group of 1 to 6 carbon atoms. It is believed that if R' is much longer than about 8 carbon atoms, the effectiveness of this component as a seal-conditioning agent may be less apparent.

Such materials include esters of salicylic acids (including hydrocarbyl-substituted salicylic acids). Examples include methyl salicylate, ethyl salicylate, butyl salicylate, 2-ethylhexyl salicylate, decyl salicylate, benzyl salicylate, phenyl salicylate, and the corresponding esters of 4-hydroxy-benzoic acid and of 3,-5-di-t-butylbenzoic acid. Examples of salicylates include materials represented by the formula

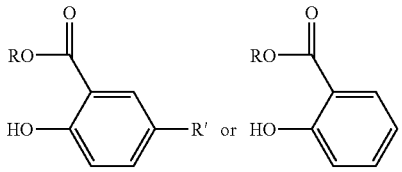

wherein R' is an alkyl group of 1 to 6 carbon atoms and R is an alkyl, aryl, or aralkyl group, or more generally

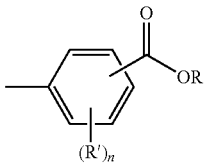

where n is 0 or 1 and R and R' are as defined above.

These agents can also be any of certain other phenolic antioxidants, including in particular esters of 4-hydroxy benzoic acid; esters of 4-hydroxy-3,5-di-tert-butyl benzoic acid; and hindered phenolic adducts of alkyl acrylates. Certain of the latter materials, for instance, may be represented by the formula

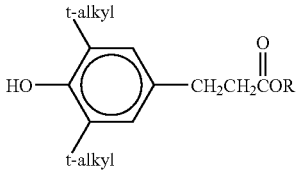

and in one embodiment,

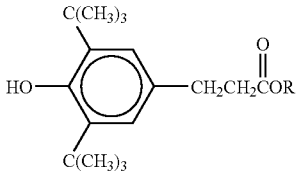

In these structures R can be a straight chain or branched chain hydrocarbyl group, such as an alkyl group, containing 2 to 6 carbon atoms, or 2 to 4, or simply about 4 carbon atoms. Alternatively, R can be an aryl group of 6 to 10 carbon atoms (e.g., phenyl or naphthyl) or an aralkyl group of 7 to 8 carbon atoms (e.g., benzyl). In one embodiment, R is an n-butyl group. In another embodiment, R is a phenyl group. Other esters include amyl esters and benzyl esters.

Hindered, ester-substituted phenols of this type can be prepared by heating a 2,6-dialkylphenol with an acrylate ester under base catalysis conditions, such as aqueous KOH. Their synthesis and properties are described in greater detail in U.S. Pat. No. 6,559,105 see in particular Example 1, which provides the reaction product of di-butylphenol+butyl acrylate.

Another type of antioxidant seal conditioning agent, in which the alkylene group R" is substituted with a second phenolic group, can be the product of acid-catalyzed gloxylation of hindered phenols such as 2,6-ti-tert-butylphenol with glyoxylic acid esters. An example of the product of such condensation can be represented by the following structure:

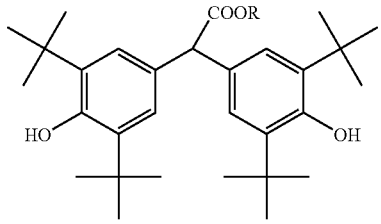

where R is a hydrocarbyl group of 1 to 6 carbon atoms.

The amount of the ester-containing phenolic antioxidant seal-conditioning agent in a fully formulated lubricant may typically be 0.05 to 20, or 0.1 to 5.0 percent by weight. Its concentration in a concentrate will be correspondingly increased, to, e.g., 1 to 75 weight percent.

(B) The Second Seal-Conditioning Agent

Another component of the present invention is a material, component (B), known as a seal-conditioning agent or seal-swell agent, which does not necessarily provide significant anti-oxidant performance to the system. However, along with component (A), it serves to further enhance swelling or apparent regeneration of elastomeric seals in machinery and equipment, thus preventing much leakage due to shrinkage of seals over time. This material is selected from the group consisting of sulfolanes, benzyl esters, lactones, nitriles, and hindered phenolic materials including ester-containing phenolic antioxidant seal-conditioning agents other than the agent selected for (A), above.

In one embodiment, component (B) is a sulfolane seal-conditioning agent, specific examples of which include 3-alkoxysulfolanes, as described in greater detail in U.S. Pat. No. 4,029,587. Such materials may be represented by the general formula

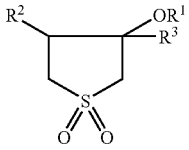

wherein $R^1$ is a hydrocarbon radical having at least about 4 carbon atoms and each of $R^2$ and $R^3$ is independently hydrogen or a lower alkyl radical. By lower alkyl radical is meant one containing 1 to 7 carbon atoms, such as methyl, ethyl, propyl, butyl, hexyl, all isomers being included, including linear. In one embodiment, $R^2$ and $R^3$ are both hydrogen. $R^1$ typically contains 1 to 100 carbon atoms, such as 4 to 25 or 6 to 10, examples of which are provided in U.S. Pat. No. 4,029,587, column 4. In one embodiment $R^1$ is decyl, in particular isodecyl, in which case the sulfolane may be represented by the formula

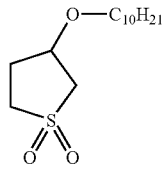

which is, in particular, 3-decyloxy-tetrahydro-thiophene 1,1-dioxide. Alternatively, $R^3$ can be a combination of isobutyl radical with a mixture of primary amyl radicals, the isobutyl material comprising 35 to 75% by weight of the combination.

The sulfolanes can be prepared by the reaction of 3-sulfolene or a substituted derivative thereof with the appropriate alcohol or alcohols as described, for instance, in U.S. Pat. No. 2,393,925 and in the above-mentioned U.S. Pat. No. 4,029,587.

The amount of the sulfolane seal-swell agent in a fully formulated lubricant, if this component is selected, can be 0.05 to 20, or 0.1 to 5.0 percent by weight. Its concentration in a concentrate will be correspondingly increased, to, e.g., 1 to 75 weight percent.

Other, or additional, seal-swell agents can be employed as, or as a part of, component (B). Such materials include, generally, benzyl esters, lactones, and nitriles. Specific examples include decanolactone (5-hydroxydecanoic acid δ-lactone), dodecanolactone (5-hydroxydodecanoic acid δ-lactone), isodecyl-(bicycloheptyl carboxylactone)carboxylate, benzyl butyl phthalate, benzyl $C_9$-$C_{11}$ alkyl phthalate, benzyl benzoate, and 3-decyloxypropionitrile. Also suitable are lactone esters prepared from hydration and partial esterification of alkylene-substituted succinic anhydrides as shown, for example, below:

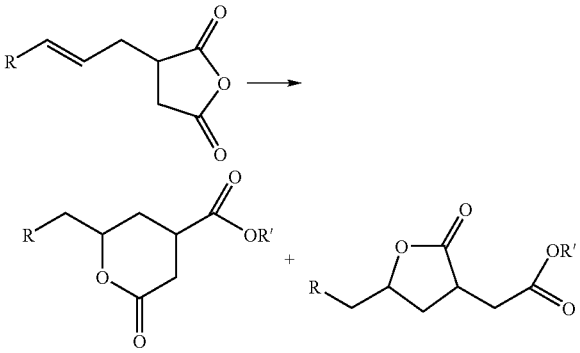

where R can be an alkyl group of, for instance, 1 to 20 carbon atoms, e.g., 9, and R' can be, e.g., $C_1$-$C_8$ alkyl or benzyl, derived from the corresponding alcohol. Further lactone seal-conditioning agents include caprolactone, substituted caprolactones, and certain aryl-fused-ring butyrolactones. The latter may be made by acid-catalyzed glyoxylation reactions of alkylphenols such as t-butylphenol, t-octylphenol, dodecylphenol, and 2,4-dialky-butylphenols. The products may be monomeric or dimeric, as shown below, depending on reaction conditions.

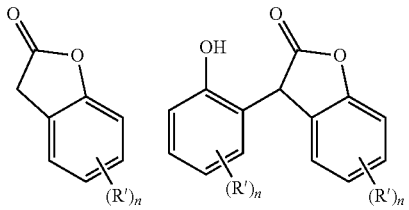

where R' is a hydrocarbyl group of 4 to 12 carbon atoms and n is 0, 1, or 2.

Other materials suitable as the additional seal-swell agents can include 2,6-di-t-butyl-4-dodecylphenol, 2-ethylhexyl-3-(4-hydroxy-3,5-di-t-butyphenol)propionate, and salicylates such as 2-ethylhexyl salicylate (provided that such material is not selected as the antioxidant seal conditioner of (A)).

The amount of the other or additional seal-swell agent in a completely formulated lubricant will typically be 0.05 to 5 percent by weight, such as 0.25 to 2.0 percent by weight, or 0.3 to 1.5 percent by weight. Its concentration in a concentrate will be correspondingly increased, to, e.g., 1 to 75 weight percent.

The relative amounts of components (A) and (B) will typically be 5-95% (A) and 95-5% (B), based on the total amount of (A) plus (B) in the composition, in terms of weight percent. Alternative amounts are 15-85% (A) and 85-15% (B), or 30-70% (A) and 70-30% (B).

The additives (A) and (B) can be used in a concentrate or in a final lubricant formulation. In a final lubricant, the total amount of (A) plus (B) can typically be 0.1 to 25% by weight, and in other embodiments 1 to 20% or 3 to 15% or 5 to 15% or to 10%. In a concentrate, the amounts will be proportionately increased to, for example, 2 to 50% or 5 to 20%, in a suitable diluent such as oil or other solvents such as toluene, xylene, or $C_{4-18}$ alkylbenzenes.

Specific examples of mixtures of seal conditioners (A) and (B) include the following:

| Ex. | Sulfolane | wt. % | Antioxidant Seal Conditioner | wt. % |
|---|---|---|---|---|
| 1 | 3-decyloxy-tetrahydro-thiophene 1,1-dioxide | 50 | 2-ethylhexyl salicylate | 50 |
| 2 | (same) | 33 | 2-ethylhexyl salicylate | 67 |
| 3 | " | 67 | 2-ethylhexyl salicylate | 33 |
| 4 | " | 50 | product of 2,6-di-t-butylphenol + butyl acrylate | 50 |
| 5 | " | 33 | prod. of 2,6-di-t-butylphenol + butyl acrylate | 67 |
| 6 | " | 67 | product of 2,6-di-t-butylphenol + butyl acrylate | 33 |

Various ternary mixtures of seal conditioners are contemplated, including following examples:

| Ex. | Sulfolane | wt % | Antioxidant Seal Conditioner | wt % | Supplemental Agent | wt. % |
|---|---|---|---|---|---|---|
| 7 | same as Ex. 4 | 33[a] | same as Ex. 4 | 33 | decanolactone | 33 |
| 8 | " | 25 | " | 50 | decanolactone | 25 |

-continued

| Ex. | Sulfolane | wt % | Antioxidant Seal Conditioner | wt % | Supplemental Agent | wt. % |
|---|---|---|---|---|---|---|
| 9 | " | 25 | " | 25 | decanolactone | 50 |
| 10 | " | 50 | " | 25 | decanolactone | 25 |
| 11 | " | 40 | " | 40 | decanolactone | 20 |
| 12 | " | 33 | " | 33 | benzyl $C_{9-11}$ alkyl phthalate | 33 |
| 13 | " | 20 | " | 40 | benzyl $C_{9-11}$ alkyl phthalate | 40 |
| 14 | " | 40 | " " | 40 | benzyl $C_{9-11}$ alkyl phthalate | 20 |
| 15 | " | 33 | " | 33 | 3-decyloxypropionitrile | 33 |
| 16 | " | 25 | " | 25 | 3-decyloxypropionitrile | 50 |
| 17 | " | 50 | " | 25 | 3-decyloxypropionitrile | 25 |
| 18 | " | 33 | " | 33 | isodecyl-(bicycloheptyl carboxylactone) carboxylate | 33 |
| 19 | " | 25 | " | 50 | isodecyl-(bicycloheptyl carboxylactone) carboxylate | 25 |
| 20 | (same) | 50 | (same) | 25 | isodecyl-(bicycloheptyl carboxylactone) carboxylate | 25 |

[a]In this table, values of 33 are rounded from "33.3".

The following are additional examples of the present invention:

| Ex. | A | wt. % | B | wt. % |
|---|---|---|---|---|
| 21 | product of di-t-butyl phenol + butyl acrylate | 50 | decanolactone | 50 |
| 22 | (same) | 33 | decanolactone | 67 |
| 23 | " | 67 | decanolactone | 33 |
| 24 | " | 50 | benzyl butyl phthalate | 50 |
| 25 | " | 33 | benzyl butyl phthalate | 67 |
| 26 | " | 67 | benzyl butyl phthalate | 33 |
| 27 | " | 50 | benzyl $C_{9-11}$ alkyl phthalate | 50 |
| 28 | " | 33 | benzyl $C_{9-11}$ alkyl phthalate | 67 |
| 29 | " | 67 | benzyl $C_{9-11}$ alkyl phthalate | 33 |
| 30 | " | 50 | isodecyl-(bicycloheptyl carboxylactone) carboxylate | 50 |
| 31 | " | 33 | isodecyl-(bicycloheptyl carboxylactone) carboxylate | 67 |
| 32 | " | 67 | isodecyl-(bicycloheptyl carboxylactone) carboxylate | 33 |
| 33 | " | 50 | 2,6-di-t-butyl-4-dodecylphenol | 50 |
| 34 | " | 33 | 2,6-di-t-butyl-4-dodecylphenol | 67 |
| 35 | " | 67 | 2,6-di-t-butyl-4-dodecylphenol | 33 |
| 36 | " | 50 | 2-ethylhexyl salicylate | 50 |
| 37 | " | 33 | 2-ethylhexyl salicylate | 67 |
| 38 | " | 67 | 2-ethylhexyl salicylate | 33 |
| 39 | " | 50 | 2-ethylhexyl-3-(4-hydroxy-3,5-di-t-butylphenyl) propionate | 50 |
| 40 | " | 33 | 2-ethylhexyl-3-(4-hydroxy-3,5-di-t-butylphenyl) propionate | 67 |
| 41 | (same) | 67 | 2-ethylhexyl-3-(4-hydroxy-3,5-di-t-butylphenyl) propionate | 33 |

(C) Other Components

Other components may be present in amounts which are suitable to the end use to which the lubricant is to be employed. Lubricants for automatic transmissions will typically have their own spectrum of additives; similarly lubricants for engine oils (passenger car, or heavy duty diesel, or marine diesel, or small two-cycle) will each have their characteristic additives, which are well known to those skilled in the art of lubricating such devices. In general, lubricant formulations can optionally include any of the following materials:

(C-1) Dispersants

Dispersants are well known in the field of lubricants and include primarily what are sometimes referred to as "ashless" dispersants because (prior to mixing in a lubricating composition) they do not contain ash-forming metals and they do not normally contribute any ash forming metals when added to a lubricant. Dispersants are characterized by a polar group attached to a relatively high molecular weight hydrocarbon chain.

One class of dispersant is Mannich bases. These are materials which are formed by the condensation of a higher molecular weight, alkyl substituted phenol, an alkylene polyamine, and an aldehyde such as formaldehyde and are described in more detail in U.S. Pat. No. 3,634,515. Another class of dispersant is high molecular weight esters. These materials are similar to Mannich dispersants or the succinimides described below, except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022. Other dispersants include polymeric dispersant additives, which are generally hydrocarbon-based polymers which contain polar functionality to impart dispersancy characteristics to the polymer.

A preferred class of dispersants is the carboxylic dispersants. Carboxylic dispersants include succinic-based dispersants, which are the reaction product of a hydrocarbyl substituted succinic acylating agent with an organic hydroxy compound or, in certain embodiments, an amine containing at least one hydrogen attached to a nitrogen atom, or a mixture of said hydroxy compound and amine. The term "succinic acylating agent" refers to a hydrocarbon-substituted succinic acid or succinic acid-producing compound. Such materials typically include hydrocarbyl-substituted succinic acids, anhydrides, esters (including half esters) and halides. Succinimide dispersants are more fully described in U.S. Pat. Nos. 4,234,435 and 3,172,892.

Succinic based dispersants have a wide variety of chemical structures including typically structures such as

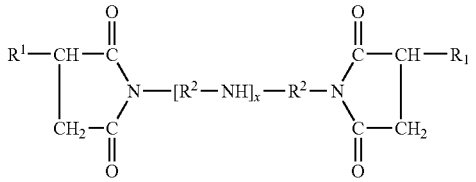

wherein each $R^1$ is independently a hydrocarbyl group, such as a polyolefin-derived group having an $\overline{M}_n$ of 500 or 700 to 10,000. Typically the hydrocarbyl group is an alkyl group, frequently a polyisobutyl group with a molecular weight of 500 or 700 to 5000, or in another embodiment, 1500 or 2000 to 5000. Alternatively expressed, the $R^1$ groups can contain 40 to 500 carbon atoms and in certain embodiments at least 50, e.g., 50 to 300 carbon atoms, such as aliphatic carbon atoms. Each $R^1$ group may contain one or more reactive groups, e.g., succinic groups., The $R^2$ are alkenyl groups, commonly —$C_2H_4$— groups. Such molecules are commonly derived from reaction of an alkenyl acylating agent with a polyamine, and a wide variety of linkages between the two moieties is possible beside the simple imide structure shown above, including a variety of amides and quaternary ammonium salts.

The amines which are reacted with the succinic acylating agents to form the carboxylic dispersant composition can be monoamines or polyamines. Polyamines include principally alkylene polyamines such as ethylene polyamines (i.e., poly (ethyleneamine)s), such as ethylene diamine, triethylene tetramine, propylene diamine, decamethylene diamine, octamethylene diamine, di(heptamethylene) triamine, tripropylene tetramine, tetraethylene pentamine, trimethylene diamine, pentaethylene hexamine, di(-trimethylene)triamine. Higher homologues such as are obtained by condensing two or more of the above-illustrated alkylene amines likewise are useful. Tetraethylene pentamines is particularly useful.

Hydroxyalkyl-substituted alkylene amines, i.e., alkylene amines having one or more hydroxyalkyl substituents on the nitrogen atoms, likewise are useful, as are higher homologues obtained by condensation of the above-illustrated alkylene amines or hydroxy alkyl-substituted alkylene amines through amino radicals or through hydroxy radicals.

The dispersants may be borated materials. Borated dispersants are well-known materials and can be prepared by treatment with a borating agent such as boric acid. Typical conditions include heating the dispersant with boric acid at 100 to 150° C. The dispersants may also be treated by reaction with maleic anhydride as described in PCT application US99/23940 filed 13 Oct. 1999.

The amount of the dispersant in a completely formulated lubricant, if present, will typically be 0.5 to 10 percent by weight, or 1 to 8 percent by weight, or 3 to 7 percent by weight. Its concentration in a concentrate will be correspondingly increased, to, e.g., 5 to 80 weight percent.

(C-2) Detergents

Detergents are generally salts of organic acids, which are often overbased. Metal overbased salts of organic acids are widely known to those of skill in the art and generally include metal salts wherein the amount of metal present exceeds the stoichiometric amount. Such salts are said to have conversion levels in excess of 100% (i.e., they comprise more than 100% of the theoretical amount of metal needed to convert the acid to its "normal" or "neutral" salt). They are commonly referred to as overbased, hyperbased or superbased salts and are usually salts of organic sulfur acids, organic phosphorus acids, carboxylic acids, phenols or mixtures of two or more of any of these. As a skilled worker would realize, mixtures of such overbased salts can also be used.

The overbased compositions can be prepared based on a variety of well known organic acidic materials including sulfonic acids, carboxylic acids (including substituted salicylic acids), phenols, phosphonic acids, saligenins, salixarates, and mixtures of any two or more of these. These materials and methods for overbasing of them are well known from numerous U.S. Patents.

The basically reacting metal compounds used to make these overbased salts are usually an alkali or alkaline earth metal compound, although other basically reacting metal compounds can be used. Compounds of Ca, Ba, Mg, Na and Li, such as their hydroxides and alkoxides of lower alkanols are usually used. Overbased salts containing a mixture of ions of two or more of these metals can be used in the present invention.

Overbased materials are generally prepared by reacting an acidic material (typically an inorganic acid or lower carboxylic acid, such as carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter. The acidic organic compound will, in the present instance, be the above-described saligenin derivative.

The acidic material used in preparing the overbased material can be a liquid such as formic acid, acetic acid, nitric acid, or sulfuric acid. Acetic acid is particularly useful. Inorganic acidic materials can also be used, such as HCl, $SO_2$, $SO_3$, $CO_2$, or $H_2S$, e.g., $CO_2$ or mixtures thereof, e.g., mixtures of $CO_2$ and acetic acid.

Patents specifically describing techniques for making basic salts of acidic organic compounds generally include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109. Overbased saligenin derivatives are described in PCT publication WO 2004/048503; overbased salixarates are described in PCT publication WO 03/018728.

The detergents generally can also be borated by treatment with a borating agent such as boric acid. Typical conditions include heating the detergent with boric acid at 100 to 150° C., the number of equivalents of boric acid being roughly equal to the number of equivalents of metal in the salt. U.S. Pat. No. 3,929,650 discloses borated complexes and their preparation.

The amount of the detergent component in a completely formulated lubricant, if present, will typically be 0.5 to 10 percent by weight, such as 1 to 7 percent by weight, or 1.2 to 4 percent by weight. Its concentration in a concentrate will be correspondingly increased, to, e.g., 5 to 65 weight percent.

(C-3) Metal Salts of a Phosphorus Acid

Metal salts of the formula

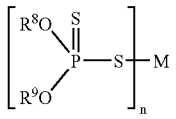

wherein $R^8$ and $R^9$ are independently hydrocarbyl groups containing 3 to 30 carbon atoms are readily obtainable by the reaction of phosphorus pentasulfide ($P_2S_3$) and an alcohol or phenol to form an O,O-dihydrocarbyl phosphorodithioic acid corresponding to the formula

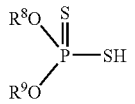

The metal M, having a valence n, generally is aluminum, lead, tin, manganese, cobalt, nickel, zinc, or copper, and in certain embodiments, zinc. The basic metal compound can thus be zinc oxide, and the resulting metal compound is represented by the formula

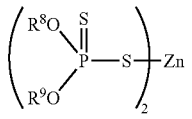

The $R^8$ and $R^9$ groups are independently hydrocarbyl groups that may be free from acetylenic and usually also from ethylenic unsaturation. They are typically alkyl, cycloalkyl, aralkyl or alkaryl group and have 3 to 20 carbon atoms, such as 3 to 16 carbon atoms or up to 13 carbon atoms, e.g., 3 to 12 carbon atoms. The alcohols which react to provide the $R^8$ and $R^9$ groups can be one or more primary alcohols, one or more secondary alcohols, a mixture of secondary alcohol and primary alcohol. A mixture of two secondary alcohols such as isopropanol and 4-methyl-2-pentanol is often desirable.

Such materials are often referred to as zinc dialkyldithiophosphates or simply zinc dithiophosphates. They are well known and readily available to those skilled in the art of lubricant formulation.

The amount of the metal salt of a phosphorus acid in a completely formulated lubricant, if present, will typically be 0.1 to 5 percent by weight, such as 0.3 to 2 percent by weight, or 0.5 to 1.5 percent by weight. Its concentration in a concentrate will be correspondingly increased, to, e.g., 5 to 60 weight percent.

(C-4) Other

The compositions of the present invention may also include, or exclude, conventional amounts of other components which are commonly found in lubricating compositions. For instance, corrosion inhibitors, extreme pressure agents, and anti-wear agents include but are not limited to dithiophosphoric esters; chlorinated aliphatic hydrocarbons; boron-containing compounds including borate esters; and molybdenum compounds. Viscosity improvers include but are not limited to polyisobutenes, polymethyacrylate acid esters, polyacrylate acid esters, diene polymers, polyalkyl styrenes, alkenyl aryl conjugated diene copolymers, polyolefins and multifunctional viscosity improvers. Dispersant viscosity improvers are also useful, that is, viscosity improvers which are functionalized to impart supplemental dispersancy to the formulation. Pour point depressants are a particularly useful type of additive, often included in the lubricating oils described herein, usually comprising substances such as polymethacrylates, styrene-based polymers, crosslinked alkyl phenols, or alkyl naphthalenes. See for example, page 8 of "Lubricant Additives" by C. V. Smalheer and R. Kennedy Smith (Lesius-Hiles Company Publishers, Cleveland, Ohio, 1967). Anti-foam agents used to reduce or prevent the formation of stable foam include silicones or organic polymers. Examples of these and additional anti-foam compositions are described in "Foam Control Agents", by Henry T. Kerner (Noyes Data Corporation, 1976), pages 125-162. Additional antioxidants can also be included, typically of the aromatic amine or hindered phenol type. These and other additives which may be used in combination with the present invention are described in greater detail in U.S. Pat. No. 4,582,618 (column 14, line 52 through column 17, line 16, inclusive).

The compositions of the present invention exhibit several advantages. Engine seals, for example, particularly in older vehicles, have a tendency to dry out and shrink over time, and a powerful seal swell agent may effectively reswell and soften the dried seals, regenerating them so they will perform their originally intended function. Seal swell agents are useful, for example, in preventing deterioration of both Viton™ and nitrile rubber seals, as evaluated in the MTU (Michigan Technical University) seal screen test in a passenger car motor oil GF-2 formulation, in which all candidates are evaluated initially at 1% concentration in the blend as a typical treat level at which seal swell performance is evaluated.

In one series of tests, certain antioxidant-seal conditioning agent are evaluated with aged seals. Virgin seals are first subjected to prolonged high temperature oxidation for one week in typical oil formulations, until they have "aged" and developed characteristic surface cracking to various degrees. Then, the lubricant blends are replaced with similar formulations containing the anti-oxidant-seal conditioning agents, and the testing is continued for an additional week. For certain agents, the surface appearance of the elastomeric seals is found to be stable, with no further deterioration in appearance or cracking.

In subsequent testing, it is found that mixtures of different types of agents, as described above, affect seal swelling at least as effectively as, or more effectively than, the individual agents used alone. Mixtures of seal conditioners which are most effective with the difficult-to-swell Viton™ elastomer, when combined with conditioners that are normally only effective with easy-to-swell elastomers such as nitrile or silicone rubber, are found to be more universally effective swelling and conditioning agents for a wide variety of elastomeric materials, as well as preventing oxidative degradation of the elastomers.

Example 42

The following is an example of a fully formulated lubricant containing the composition of the present invention:

A lubricant suitable for an automatic transmission is prepared in a 4 $mm^2/s$ (cSt at 100° C.) group III base stock containing 0.5 wt. % of the sulfolane seal swell agent of Example 1, 0.5 wt. % of the supplemental seal conditioner of Example 4, along with other, conventional, components including 2 wt. % succinimide dispersant, 0.1 wt. % overbased calcium detergent(s), 0.2 wt. % phosphorus-containing antiwear agent(s), 0.5 wt. % amine antioxidant, 0.1 wt. % friction modifying agent(s) and 2 wt. % viscosity modifier (each amount ex-pressed on an oil-free basis). When such a formulation is subjected to seal test conditions required for original equipment manufacturer approval, superior performance will be achieved.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. It is to be understood that the upper and lower amount, range, and ratio limits set forth herein may be independently combined. As used herein, the expression "consisting essentially of" permits the inclusion of substances which do not materially affect the basic and novel characteristics of the composition under consideration.

What is claimed is:

1. A method for lubricating a mechanical device comprising elastomeric materials, comprising supplying thereto a lubricant formulation comprising an oil of lubricating viscosity and:

(A) at least one ester-containing phenolic antioxidant seal-conditioning agent represented by the formula

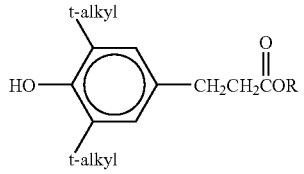

wherein R is an alkyl group of 2 to 6 carbon atoms; and (B) at least one second seal-conditioning agent comprising a sulfolane represented by the general formula

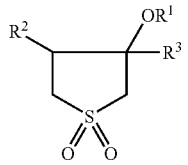

wherein $R^1$ is a hydrocarbon group having at least about 4 carbon atoms and each of $R^2$ and $R^3$ is independently hydrogen or an alkyl group of 1 to about 7 carbon atoms;

wherein the amounts of components (A) and (B) are in the ratio of about 5:95 to about 95:5 by weight and the total amount of components (A) and (B) is about 1 to about 15 percent by weight of the composition.

2. The method of claim 1 wherein R is an alkyl group of 2 to 4 carbon atoms.

3. The method of claim 1 wherein the t-alkyl groups are t-butyl groups.

4. The method of claim 1 wherein $R^1$ is decyl and $R^2$ and $R^3$ are hydrogen.

5. The method of claim 1 wherein (B) further comprises an additional agent selected from benzyl esters, lactones, nitriles, and ester-containing phenolic antioxidant seal-conditioning agents other than the agent of (A).

6. The method of claim 1 wherein the lubricant formulation further comprises at least one dispersant, detergent, metal salt of a phosphorus acid, corrosion inhibitor, extreme pressure agent, anti-wear agent, viscosity improver, or pour point depressant.

7. The method of claim 1 wherein the mechanical device is an automatic transmission or an internal combustion engine.

* * * * *